United States Patent [19]

Baumann

[11] Patent Number: 4,461,326

[45] Date of Patent: Jul. 24, 1984

[54] WARP STOP MOTION DEVICE OF A WEAVING MACHINE

[75] Inventor: Hans Baumann, Horgen, Switzerland

[73] Assignee: Grob & Co. Aktiengesellschaft, Horgen, Switzerland

[21] Appl. No.: 426,660

[22] Filed: Sep. 29, 1982

[30] Foreign Application Priority Data

Dec. 11, 1981 [DE] Fed. Rep. of Germany ..... 3149235

[51] Int. Cl.[3] ..... D03D 51/28

[52] U.S. Cl. ..... 139/369

[58] Field of Search ..... 139/92, 358, 369; 242/157 R; 66/163

[56] References Cited

U.S. PATENT DOCUMENTS

| | | | |
|---|---|---|---|
| 1,152,905 | 9/1915 | Raymond | 139/369 |
| 1,760,967 | 6/1930 | Shutt | 139/369 |
| 1,873,214 | 8/1932 | Payne | 139/358 |
| 3,421,552 | 1/1969 | Sotek | 139/369 |
| 3,584,659 | 6/1971 | Pfarrwaller | 139/369 |
| 4,293,007 | 10/1981 | Baumann | 139/369 |
| 4,385,647 | 5/1983 | Nishiguchi | 139/369 |

FOREIGN PATENT DOCUMENTS

| | | |
|---|---|---|
| 18430 | 11/1980 | European Pat. Off. . |
| 313820 | 3/1974 | Fed. Rep. of Germany . |
| 2228059 | 7/1975 | Fed. Rep. of Germany . |
| 2522151 | 7/1976 | Fed. Rep. of Germany . |
| 1093425 | 5/1955 | France . |

*Primary Examiner*—Henry Jaudon

*Attorney, Agent, or Firm*—Watson, Cole, Grindle & Watson

[57] ABSTRACT

A warp stop motion device of a weaving machine has upper and lower supports respectively for contact bars and guide bars lying in transversely spaced vertical planes with vertically extending legs thereon having adjustment and locking means to facilitate a clamped vertical adjustment between the upper and lower supports. The lower supports are cantilevered at one end to a longitudinally extending beam serving as a warp end carrying support, and the upper supports are cantilevered at one end to the one end of the lower supports. Thus, the opposite ends of the upper and lower supports are free and unsupported for the reception of the guide bars from such ends during assembly.

5 Claims, 3 Drawing Figures

WARP STOP MOTION DEVICE OF A WEAVING MACHINE

RELATED APPLICATION

This application relates to U.S. Ser. No. 426,654 filed Sept. 29, 1982, claiming priority based on German appl. Ser. No. P 31 49 219.3, filed Dec. 11, 1981, and commonly owned herewith.

BACKGROUND OF THE INVENTION

This invention relates generally to a warp stop motion device of a weaving machine in which such device is capable of being operated electrically or mechanically as in any normal manner. The device includes a plurality of spaced apart and parallel related contact bars which are respectively serrated, and a plurality of spaced apart and parallel related guide bars disposed below the serrated contact bars. An upper support assembly includes a plurality of spaced apart and parallel supports for the contact bars lying perpendicular thereto, and a lower support assembly includes a plurality of spaced apart and parallel lower supports for the guide bars lying perpendicular thereto.

Warp stop motion devices of the general class aforedescribed, when provided for large weaving widths, have correspondingly long contact and guide bars and, in order to eliminate sagging thereof, a plurality of bar supports are provided which are spaced apart from one another, the upper bar supports for the contact bars and the lower bar supports for the guide bars respectively lying in transversely spaced vertical planes. The upper and lower support assemblies are disposed for vertical adjustment therebetween. The position of the contact bars relative to the warp ends determine the height of fall of the drop wires, which are supported by the warp ends which extend between the contact bars and the guide bars through the warp stop motion device. The degree of fall of the drop wire is variably adjustable depending on the type of weave to be produced and also taking into consideration various working conditions, therefore making it essential that all of the supports for the contact bars be adjustable in height, permitting an equal adjusted distance so that a different degree of fall at the opposite ends of the contact bars is avoided. With too short a fall, faulty stoppages of the weaving machine could occur, although a short height of fall will lead to a desirable quick stoppage of the weaving machine to prevent faults in the woven fabrics.

Normally, warp stop motion devices of this type are devised as a framework for supporting the contact and guide bars, which thereby renders the complete device stable. The ends of either side of the contact bars and guide bars are inserted in supports which are connected to thread carrying tubes located on opposite sides of the framework. The guide end contact bars are disposed therebetween. Several arrangements have been proposed to assure that one of the thread carrying tubes does not interfere with the process of insertion of the contact bars, in the direction of a warp movement, considering that the drop wires are aligned with the contact bars and that the warp threads extend through eyelets in the drop wires. For example, one of the thread carrying tubes has been arranged in such a manner that it could be downwardly swiveled. Furthermore, it has been proposed that one of the thread carrying tubes could be omitted so that all bar supports are only mounted on the other thread carrying tube which permits at the same time a changing of the warp beam, to insert the individual contact bars with the corresponding drop wires, in the direction of warp movement, one after the other onto the bar supports, or all at the same time, without having to elevate the contact bars, whereby the warp threads could easily slip out of the drop wires.

With such a prior warp stop motion device, there is a drawback in that the upper bar supports for the contact bars and the lower bar supports for the guide bars, despite the adjustability between upper and lower supports, are interconnected in such a manner that the guide bars cannot be inserted from the long longitudinal side of the bar support, but only from the base, i.e. the short side, into the slots provided in the bar supports. Thus, in a weaving machine of several meters in width and having a corresponding warp stop motion device, it is essential to provide at least the same clearance available between the wall of the building and the weaving machine, corresponding to the length of the warp stop motion device. This clearance is, however, normally not available since weaving machines are normally placed close to the building walls.

SUMMARY OF THE INVENTION

The aforementioned drawbacks are avoided by the present invention which provides for an insertion of the guide bars also in the direction of the flow of the warp ends without the need for those clearances required for the prior art arrangements. The lower support assembly according to the invention is cantilevered at one end to the thread carrying tube so that the opposite end of the lower support assembly is free and unsupported. And, the upper support assembly is cantilevered at one end to the one end of the lower support assembly so that the opposite end of the upper support is likewise free and unsupported. Means are provided for adjusting the vertical spacing between the upper and lower support assemblies to facilitate insertion of the guide bars into open slots provided in the lower guide bar supports, insertion taking place from the free ends of the supports, and the lower support assembly being attachably mounted to the beam. The respective supports of the upper and lower support assemblies lie in transversely spaced vertical planes and are provided with abutting vertically extending legs with means thereon for adjusting and thereafter locking the support assemblies relative to one another in a desired vertical spacing.

DETAILED DESCRIPTION OF THE INVENTION

Figure 1:
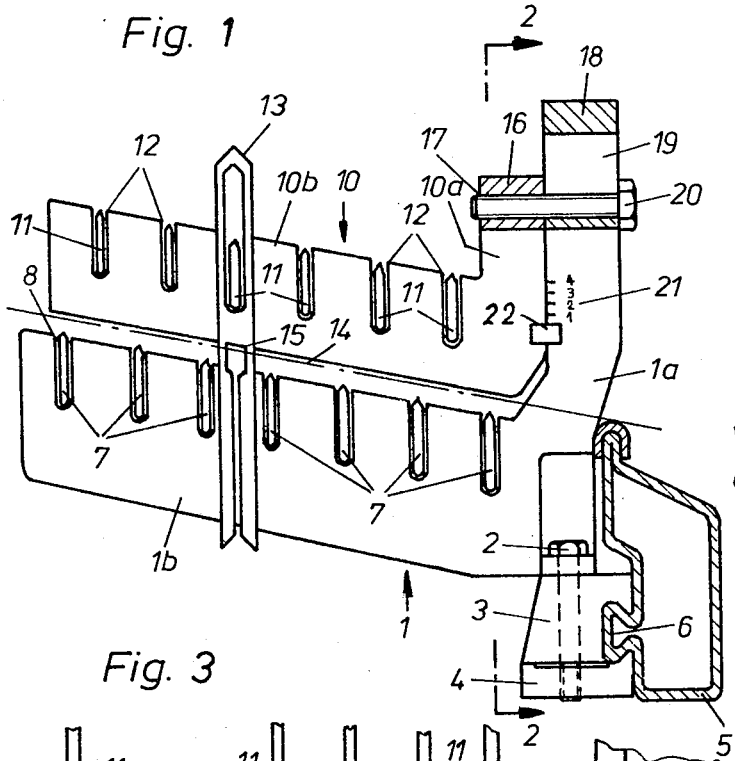
FIG. 1 is a front elevational view of contact and guide bar supports of a warp stop motion according to the invention.
Figure 2:
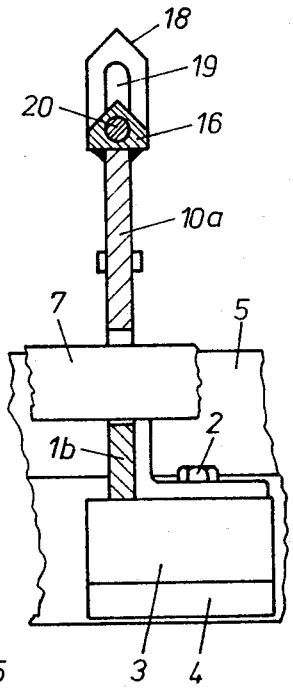
FIG. 2 is a vertical sectional view taken substantially along the line 2—2 of FIG. 1.
Figure 3:
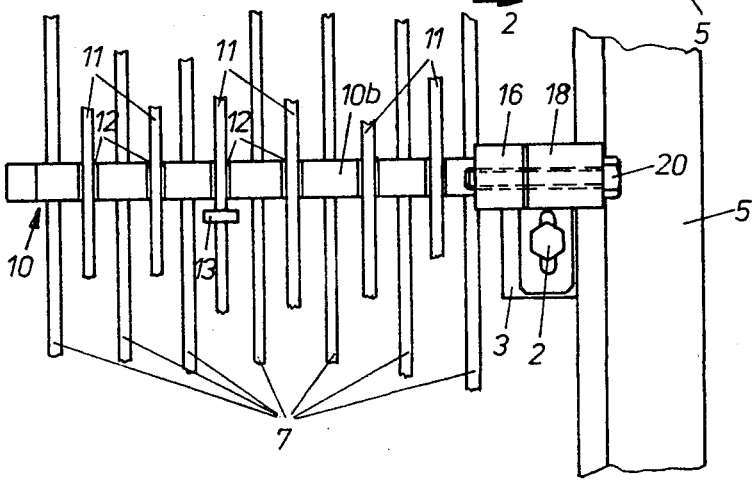
FIG. 3 is a top plan view of the FIG. 1 bar supports.

Turning now to the drawings wherein like reference characters refer to like and corresponding parts throughout the several views, a lower bar support assembly includes a plurality of spaced apart and parallel lower support bars 1, although only one is being shown in the drawings in the interest of clarity. The supports of the lower support assembly are detachably mounted at one end on a longitudinally extending beam 5 located at one side of the support assembly as a support tube for the warp ends. Mounting is effected by means of cooperating clamps 3 and 4 and a bolt 2 extending therebetween, the clamps engaging a dovetail projection 6 at one side of the beam. Each support of the lower support assembly has a vertically extending leg 1*a* and another leg 1*b* lying at an acute angle thereto. Each lower support is thus cantilevered at one end to beam 5 so that its opposite end is free and unsupported as shown in FIG. 1. A plurality of equally spaced guide bars 7, lying perpendicularly to supports 1, are disposed in upwardly open slots 8 provided at the upper edge of supports 1. Bar supports 10 of an upper support assembly are respectively vertically aligned with the supports of the lower support assembly, as typically shown in FIG. 3 for a single upper support 10 lying in the same vertical plane as a lower support 1. Each bar support 10 has a vertical leg 10*a* lying in the same vertical plane as leg 1*a* and abutting thereagainst, a leg 10*b* forming an acute angle with leg 10*a*. The upper supports of the upper support assembly are vertically adjustable relative to the supports of the lower support assembly so that the gaps between the upper and lower supports can be adjusted to the same extent for all the supports.

Equally spaced and parallel slots 12 are provided in supports 10 of the upper support assembly for the reception of contact bars 11. By setting the height of bar supports 10, the height or degree of fall of drop wires 13 (only one of which is shown for clarity) can be changed. Each drop wire rests on a warp end 14 which extends parallel to leg 10*b* and through a thread eye 15 of each drop wire 13.

Adjustment of the upper support assembly relative to the lower supports is effected by the provision of vertically extending elongated slots 19 provided in legs 1*a* at enlarged sections 18 thereof. Thickened sections 16 are secured at the upper ends of legs 10*a* and are provided with internally threaded bores 17 for the reception of bolts 20 for locking the adjusted upper supports relative to the lower supports upon a tightening of the bolts. The length of each slot 19, of course, determines the range of adjustment. And, for setting a plurality of bar supports 10 at equal height each vertical leg 1*a* is provided with indicia in the form of a scale 21, and each leg 10*a* is provided with a marker 22 associated with the scale.

Prior to assembly of the contact bars, guide bars and drop wires, upper supports 10 are upwardly adjusted to their uppermost extent, so that gaps are formed between the upper and lower supports equal to at least the width of the guide bar. A guide bar 7 may then be installed from the free ends of legs 1*b*, (from the left in FIG. 1) so as to be received in a slot 8 lying nearest vertical leg 1*a*. Thereafter, a contact bar 11 supporting lined up drop wires 13 is inserted into a slot 12 lying nearest vertical leg 10*a*, and the remaining guide bars, contact bars with drop wires are installed, alternatively, in like fashion.

Obviously, many modifications and variations of the present invention are made possible in the light of the above teachings. It is therefore to be understood that within the scope of the appended claims the invention may be practiced otherwise than as specifically described.

What is claimed is:

1. In a weaving machine having a warp stop motion device which includes a plurality of spaced apart and parallel related contact bars and a plurality of spaced apart and parallel related guide bars disposed below said contact bars, an upper support assembly comprising a plurality of spaced apart and parallel upper supports for said contact bars lying perpendicular thereto, a lower support assembly comprising a plurality of spaced apart and parallel lower supports for said guide bars lying perpendicular thereto, a warp end supporting beam lying parallel to said bars, said assemblies being adjustable vertically to a spaced apart predetermined distance, said lower support assembly being cantilevered at one end thereof to said beam so that the opposite end of said lower support assembly is free and unsupported, said upper support assembly being cantilevered at one end thereof to said one end of said lower support assembly so that the opposite end of said upper support assembly is free and unsupported, upwardly open slots at the upper edges of said lower supports for the reception of said guide bars, and means for adjusting the vertical spacing between said support assemblies, the improvement wherein the upper and lower confronting edges respectively, of said lower and upper assemblies extend to said opposite end of said respective assemblies thereof to thereby define a uniform spacing between said assemblies which is open at said opposite end of each said assembly, whereby said guide bars may be inserted into said slots between said assemblies and from said free ends thereof, said adjusting means including means for locking said assemblies after adjustment, and said lower support assembly being detachably mounted to said beam.

2. In the machine according to claim 1, wherein said upper and lower supports lie in transversely spaced vertical planes and include vertically extending abutting legs at said one end thereof so as to substantially define L-shaped supports, said adjusting and locking means being disposed on said abutting legs.

3. In the machine according to claim 2, wherein said adjusting and locking means comprise a vertically extending elongated opening in one of said legs, and a fastener extending through said opening and engaging the other of said legs.

4. In the machine according to claim 2, wherein said supports between said ends thereof form acute angles with their respective legs.

5. In the machine according to claim 2, wherein one of said abutting legs has indicia thereon forming an adjustment scale, and the other of said abutting legs has a marker thereon associated with said indicia.

* * * * *